US010950156B1

(12) United States Patent
Hsu et al.

(10) Patent No.: US 10,950,156 B1
(45) Date of Patent: Mar. 16, 2021

(54) SYSTEM OF MULTIPLE TIMING CONTROLLERS OF A DISPLAY PANEL

(71) Applicant: NOVATEK MICROELECTRONICS CORP., Hsinchu County (TW)

(72) Inventors: Tzu-Chien Hsu, Hsinchu (TW); Yu-Lin Hsu, Zhubei (TW)

(73) Assignee: NOVATEK MICROELECTRONICS CORP., Hsinchu Science Park (TW)

( * ) Notice: Subject to any disclaimer, the term of this patent is extended or adjusted under 35 U.S.C. 154(b) by 0 days.

(21) Appl. No.: 16/874,400

(22) Filed: May 14, 2020

(51) Int. Cl.
*G09G 3/20* (2006.01)

(52) U.S. Cl.
CPC ..... *G09G 3/20* (2013.01); *G09G 3/2096* (2013.01); *G09G 3/2088* (2013.01); *G09G 2310/08* (2013.01); *G09G 2330/06* (2013.01)

(58) Field of Classification Search
None
See application file for complete search history.

(56) References Cited

U.S. PATENT DOCUMENTS 6,658,043 B2 * 12/2003 Hardin ..... H03L 7/193 375/130
10,504,404 B2 * 12/2019 Kim ..... G09G 3/2018
2010/0302214 A1 * 12/2010 Kim ..... G09G 3/20 345/204
2018/0182278 A1 * 6/2018 Kim ..... G09G 3/2018

* cited by examiner

*Primary Examiner* — Dorothy Harris
(74) *Attorney, Agent, or Firm* — Hamre, Schumann, Mueller & Larson, P.C.

(57) ABSTRACT

A timing controller of a display panel includes a spread spectrum clock generator (SSCG) and a control circuit block. The SSCG performs a spread spectrum operation on a clock signal to output a modulated clock signal having a varying frequency that varies with a fixed pattern, wherein a complete cycle of the frequency variation occurs in a frequency modulation period. The control circuit block outputs display data for the display panel within a data output period related to the modulated clock signal, and outputs a synchronization signal to another timing controller of the display panel, such that the another timing controller synchronizes a spread spectrum operation performed thereby with that performed by the SSCG.

12 Claims, 7 Drawing Sheets

SYSTEM OF MULTIPLE TIMING CONTROLLERS OF A DISPLAY PANEL

FIELD

The disclosure relates to spread spectrum techniques, and more particularly to a method for synchronizing spread spectrum operations among multiple timing controllers of a display panel.

BACKGROUND

With the advancement of display techniques, a single timing controller may not be able to satisfy the requirements for a display panel with a high display resolution and a high display frequency, so the use of multiple timing controllers in a display panel has become a trend.

To reduce electromagnetic interference (EMI) originating from display panels, a common approach is to activate a spread spectrum function in the timing controller (s) . Conventional display panels with multiple timing controllers generally make display parameters the same among the timing controllers . The display parameters relate to timing controls for source drivers and gate drivers, which are usually based on clock signals used by the timing controllers. When spread spectrum operations on the clock signals respectively used by the multiple timing controllers are not in sync, the timings of data output of the timing controllers may be different. FIG. 1 illustrates such a problem as may occur when multiple timing controllers have the same display parameters and yet the spread spectrum operations thereof are out of sync. Each of the timing controllers TCON_A, TCON_B performs a spread spectrum operation on a clock signal that is generated by an oscillator and that has a constant frequency to output a modulated clock signal having a frequency that varies with time, and includes a counter that records a number of clock pulses in the modulated clock signal. For each of the timing controllers TCON_A, TCON_B, the counting speed of the counter would be high when the frequency of the modulated signal is high, and would be low when the frequency of the modulated signal is low. In addition, each of the timing controllers TCON_A, TCON_B receives the same display parameters that use the number recorded by the counter to define the timing for starting data output (e.g., the rising point in FIG. 1 indicates that the data output starts when the respective counter is on the count of ten) and the timing for ending data output (e.g., the falling point in FIG. 1 indicates that the data output ends when the respective counter is on the count of twenty-four). From FIG. 1, it can be seen that even if the display parameters are the same among multiple timing controllers, when spread spectrum operations among the timing controllers are not synchronized, it is possible that data outputs for the timing controllers TCON_A, TCON_B are also not in sync, which may result in undesired displaying defects such as V-band mura.

SUMMARY

Therefore, an object of the disclosure is to provide a timing controller of a display panel that includes multiple timing controllers. The timing controller is used to alleviate at least one of the drawbacks of the prior art.

According to the disclosure, the timing controller includes a spread spectrum clock generator (SSCG) and a control circuit block. The SSCG is disposed to receive a clock signal, and is configured to perform a spread spectrum operation on the clock signal based on a set of spreading factors, so as to output a modulated clock signal having a varying frequency that varies with a fixed pattern. One complete cycle of the frequency variation of the modulated clock signal occurs in a frequency modulation period defined by the spreading factors. The control circuit block is coupled to the SSCG for receiving the modulated clock signal, and is configured to output display data for the display panel within a data output period related to the modulated clock signal, and to output a synchronization signal to another timing controller of the display panel at a predefined time point in the frequency modulation period, such that the another timing controller synchronizes a spread spectrum operation performed thereby with that performed by the SSCG upon receiving the synchronization signal.

Another object of the disclosure is to provide a method for synchronizing spread spectrum operations among multiple timing controllers of a display panel, so as to alleviate at least one of the drawbacks of the prior art. The method includes: by an SSCG of a timing controller of the display panel, performing a spread spectrum operation on a clock signal received thereby based on a set of spreading factors, and outputting a modulated clock signal having a varying frequency that varies with a fixed pattern, wherein one complete cycle of the frequency variation of the modulated clock signal occurs in a frequency modulation period defined by the spreading factors; and by a control circuit block of the timing controller, receiving the modulated clock signal from the SSCG, outputting display data for the display panel within a data output period related to the modulated clock signal, and outputting a synchronization signal to another timing controller of the display panel at a predefined time point in the frequency modulation period, such that the another timing controller synchronizes a spread spectrum operation performed thereby with that performed by the SSCG upon receiving the synchronization signal.

Yet another object of the disclosure is to provide a system to manage output of display data for a display panel. The system can alleviate at least one of the drawbacks of the prior art, and includes a first timing controller and a second timing controller, each including an SSCG and a control circuit block. The SSCG of the first timing controller is disposed to receive a first clock signal, and is configured to perform a spread spectrum operation on the first clock signal based on a set of spreading factors, so as to output a modulated first clock signal having a varying frequency that varies with a fixed pattern. One complete cycle of the frequency variation of the modulated first clock signal occurs in a frequency modulation period defined by the spreading factors. The control circuit block of the first timing controller is coupled to the SSCG of the first timing controller for receiving the modulated first clock signal, and is configured to output display data for the display panel within first data output period related to the modulated first clock signal, and to output a synchronization signal at a predefined time point in the frequency modulation period. The SSCG of the second timing controller is disposed to receive a second clock signal, and is configured to perform a spread spectrum operation on the second clock signal, so as to output a modulated second clock signal having a varying frequency that varies with a fixed pattern. The control circuit block of the second timing controller is coupled to the SSCG of the second timing controller for receiving the modulated second clock signal, is coupled to the control circuit block of the first timing controller for receiving the synchronization signal, and is configured to output display data for the display panel within a second data output period related to the modulated second clock signal. The control circuit block of the second timing controller is further configured to make the SSCG of the second timing controller synchronize the spread spectrum operation performed thereby with that performed by the SSCG of the first timing controller upon receiving the synchronization signal, so as to make the modulated second clock signal synchronized with the modulated first clock signal.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
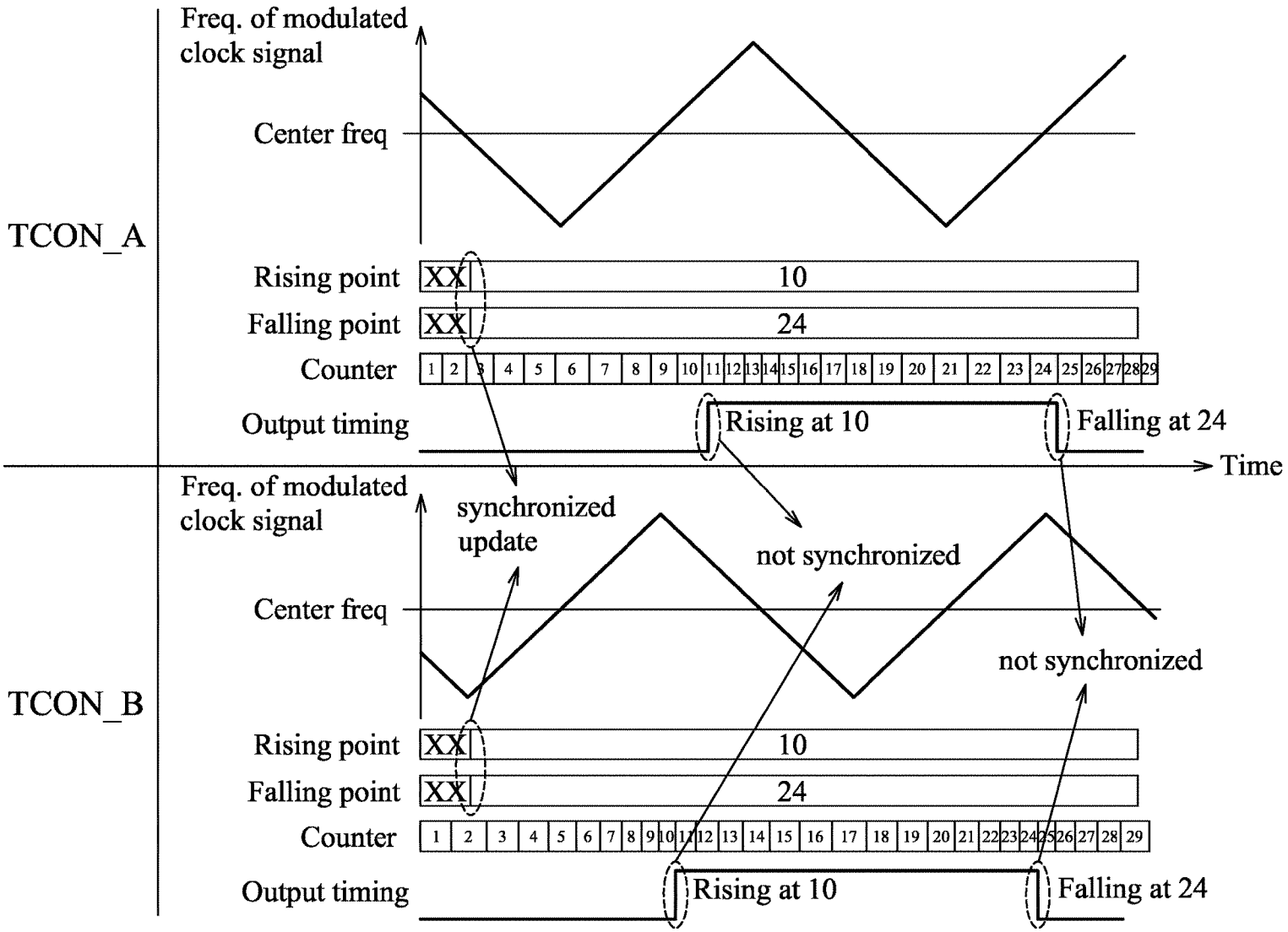
FIG. 1 PRIOR ART
FIG. 1 is a plot illustrating spread spectrum operations among multiple timing controllers being out of sync, which may occur in conventional techniques.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
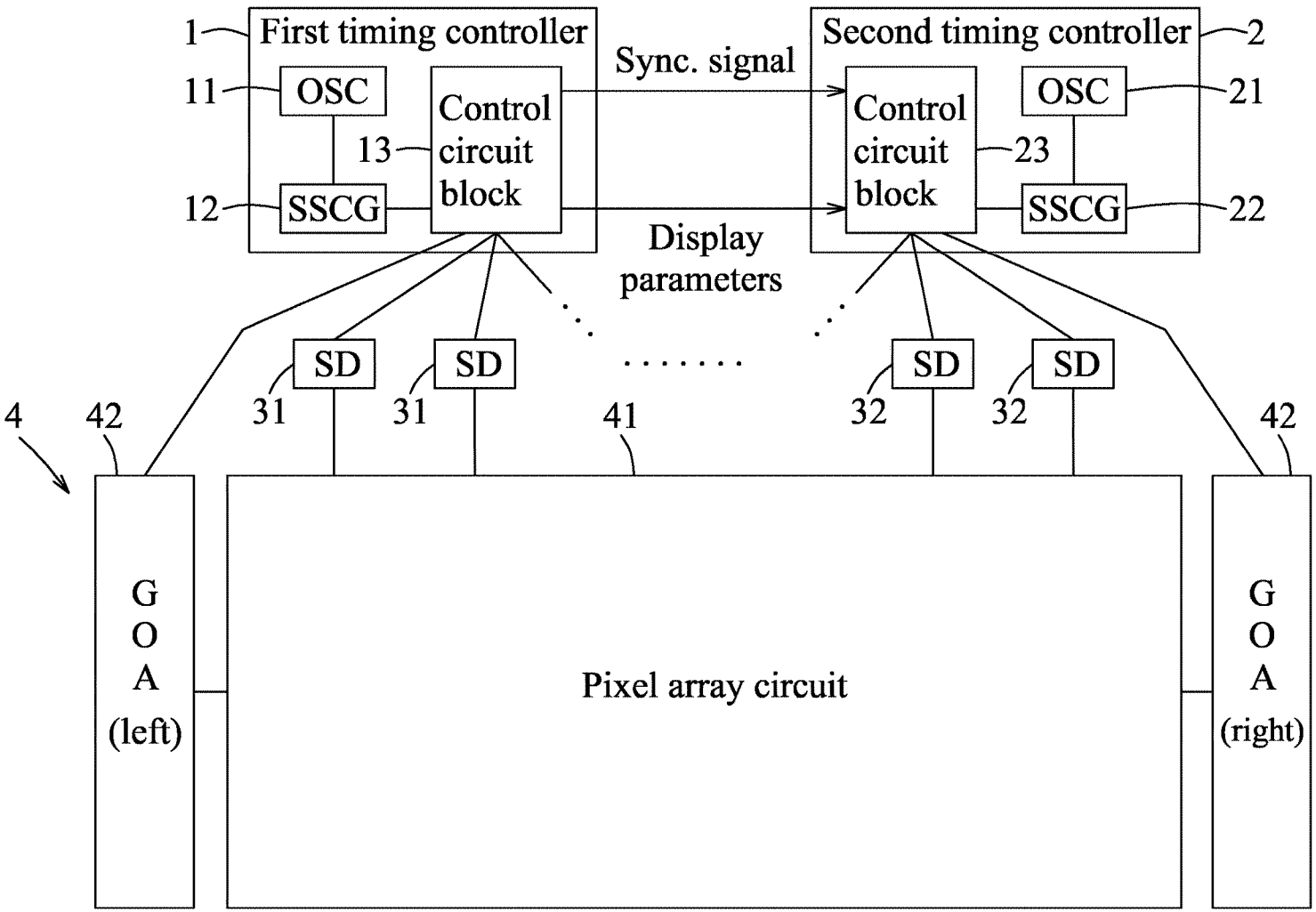
FIG. 2 is a block diagram illustrating a first embodiment of a system that includes multiple timing controllers according to this disclosure.

FIG. 2 exemplarily illustrates a first embodiment of a system that includes multiple timing controllers to manage output of display data for a display panel. In this embodiment, the system exemplarily includes a first timing controller 1 and a second timing controller 2, but this disclosure is not limited in this respect, and the system may include more timing controllers in other embodiments. The display panel includes the system, a first group of source drivers 31 coupled to the first timing controller 1, a second group of source drivers 32 coupled to the second timing controller 2, and a thin film transistor (TFT) circuit 4 that is composed of a pixel array circuit 41 and two gate-on-array (GOA) circuits 42 disposed at two sides of the pixel array circuit 41.

Figure 7:
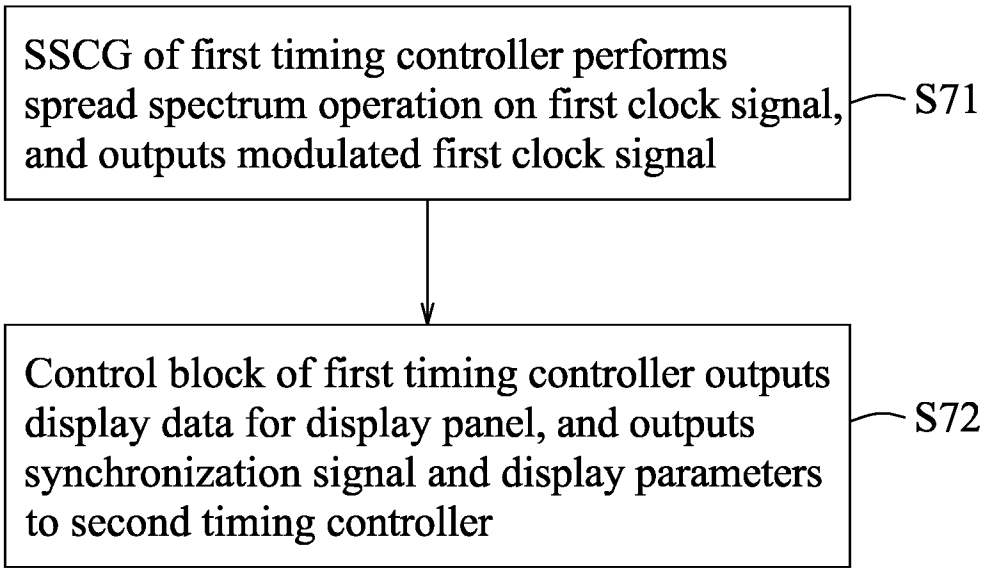
FIG. 7 is a flow chart illustrating steps of operations performed by the embodiments according to this disclosure.

Referring to FIGS. 2 and 7, the first timing controller 1 includes an oscillator 11, a spread spectrum clock generator (SSCG) 12, and a control circuit block 13. The oscillator 11 is configured to generate a first clock signal having a constant frequency. The SSCG 12 is coupled to the oscillator 11 for receiving the first clock signal therefrom, and is configured to perform a spread spectrum operation on the first clock signal based on a first set of spreading factors, so as to output a modulated first clock signal having a varying frequency that varies with a fixed pattern (i.e., a frequency vs. time graph of the modulated first clock signal is a periodic signal) (step S71). The spreading factors may define a frequency modulation period in which one complete cycle of frequency variation of the modulated first clock signal occurs, a spread ratio, and so on. The control circuit block 13 is coupled to the SSCG 12 for receiving the modulated first clock signal therefrom, and includes a counter (not shown) to record a number of clock pulses of the modulated first clock signal. The control circuit block 13 outputs display data for the display panel within a first data output period related to a number recorded by the counter thereof, and outputs a synchronization signal at a predefined time point in the frequency modulation period (step S72) . It is noted that the display data output by the first timing controller 1 may include control signals and pixel data for the corresponding portion of the GOA circuits 42 (e.g., the GOA circuit 42 at the left side of the pixel array circuit 41) and the first group of source drivers 31.

The second timing controller 2 includes an oscillator 21, an SSCG 22, and a control circuit block 23. The oscillator 21 is configured to generate a second clock signal having a constant frequency. Usually, the first clock signal and the second clock signal are configured to have the same frequency, but this disclosure is not limited in this respect. The SSCG 22 is coupled to the oscillator 21 for receiving the second clock signal therefrom, and is configured to perform a spread spectrum operation on the second clock signal based on a second set of spreading factors, so as to output a modulated second clock signal having a frequency that changes periodically. Usually, the first set of spreading factors and the second set of spreading factors are configured to be the same, but this disclosure is not limited in this respect. The control circuit block 23 is coupled to the control circuit block 13 of the first timing controller 1 for receiving the synchronization signal, is coupled to the SSCG 22 for receiving the modulated second clock signal, and includes a counter (not shown) to record a number of clock pulses of the modulated second clock signal. The control circuit block 23 outputs display data for the display panel within a second data output period related to a number recorded by the counter thereof. It is noted that the display data output by the second timing controller 2 may include control signals and pixel data for the corresponding portion of the GOA circuits 42 (e.g., the GOA circuit 42 at the right side of the pixel array circuit 41) and the second group of source drivers 32. Upon receipt of the synchronization signal, the control circuit block 23 makes the SSCG 22 synchronize the spread spectrum operation performed thereby with that performed by the SSCG 12 of the first timing controller 1, so as to make the modulated second clock signal synchronized with the modulated first clock signal, and make the first data output period and the second data output period the same.

In this embodiment, the predefined time point is a time point where the spread spectrum operation is in an initial state, and where the frequency of the modulated first clock signal is equal to a center frequency, which is the frequency of the first clock signal. Once in receipt of the synchronization signal, the control circuit block 23 of the second timing controller 2 resets the spread spectrum operation performed by the SSCG 22 to the initial state, making the spread spectrum operations performed by the SSCG 12 and the SSCG 22 synchronized with each other.

In addition to outputting the synchronization signal, the control circuit block 13 of the first timing controller 1 further outputs a set of display parameters (step S72), which define the data output period based on the modulated clock signal (e.g., the modulated first clock signal for the first timing controller 1, or the modulated second clock signal for the second timing controller 2), to the control circuit block 23 of the second timing controller 2, so as to make the control circuit block 23 output display data for the display panel based on the same display parameters as used by the control circuit block 13 of the first timing controller 1 to output display data. In the first embodiment, the control circuit block 13 outputs the display parameters to the control circuit block 23 via a first path in a format that conforms to, for example, a protocol of serial peripheral interface (SPI), and outputs the synchronization signal to the control circuit block 23 via a second path that is different from the first path in a format of a single signal that has a predetermined logic level (e.g., logic high or logic low) to trigger the synchronization procedure.

Figure 3:
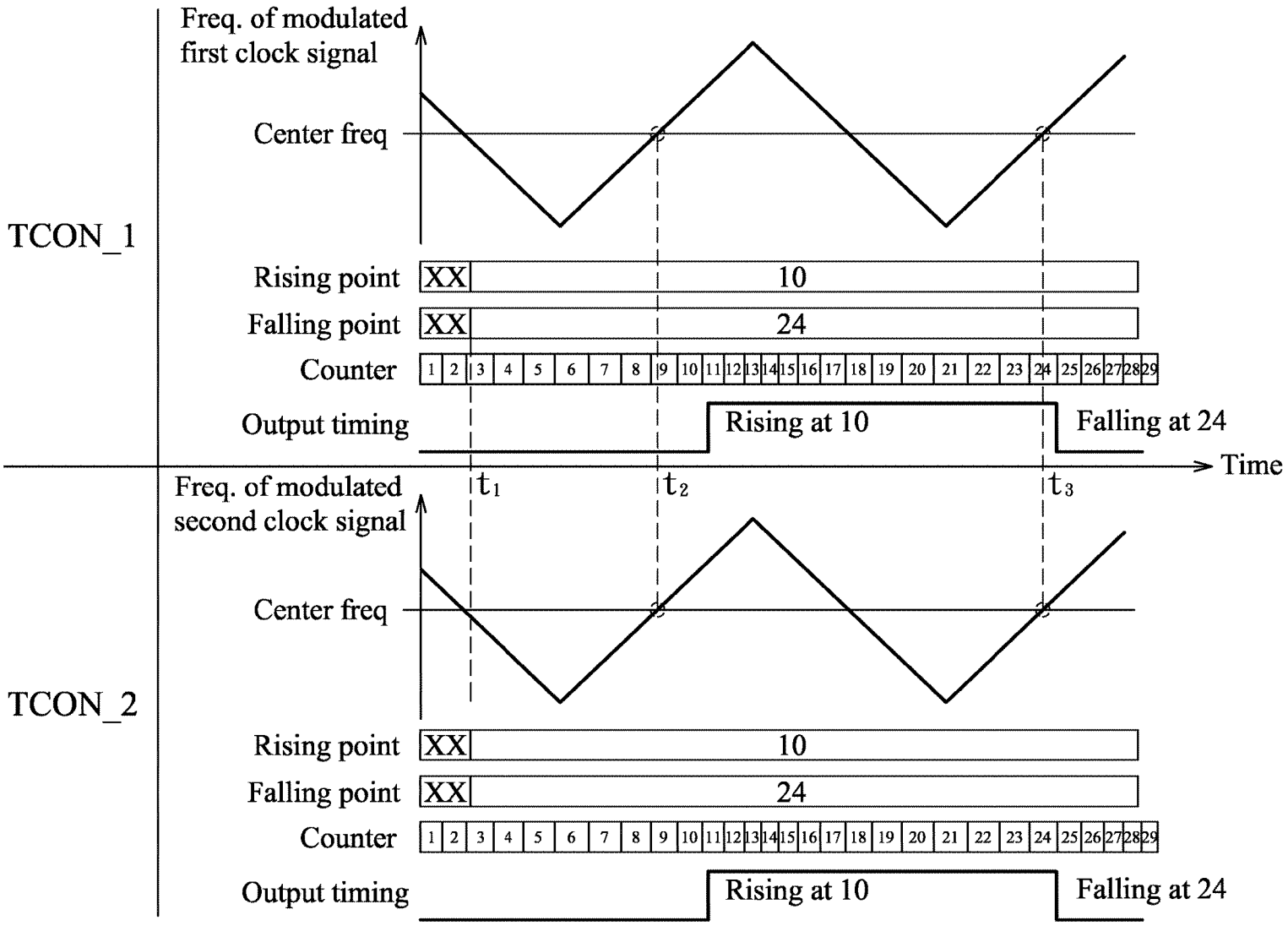
FIG. 3 is a plot illustrating synchronized spread spectrum operations among multiple timing controllers according to this disclosure.

Referring to FIGS. 2 and 3, FIG. 3 illustrates operations within the first timing controller 1 (TCON_1) and the second timing controller 2 (TCON_2) of the first embodiment. The control circuit block 13 outputs the display parameters at time point $t_1$, making the display parameters of the first and second timing controllers 1, 2 the same. The display parameters use a number recorded by the counter of the corresponding timing controller to define a rising point and a falling point, which respectively represent a timing to start output of display data and a timing to finish output of display data. In FIG. 3, the rising point and the falling point respectively correspond to "10" and "24", which means that display data is outputted when the number recorded by the corresponding counter is between 10 and 24. In FIG. 3, the control circuit block 13 outputs the synchronization signal at time point $t_2$ and time point $t_3$ (i.e., the predefined time points in the respective frequency modulation periods), with an interval therebetween being equal to the frequency modulation period. By virtue of the second timing controller 2 synchronizing the spread spectrum operation thereof with that of the first timing controller I upon receipt of the synchronization signal, the modulated first clock signal and the modulated second clock signal would have the same frequency variations at all times, so the first and second timing controllers 1, 2 have the same timing for outputting display data (i.e., the first data output period and the second data output period are the same).

Figure 4:
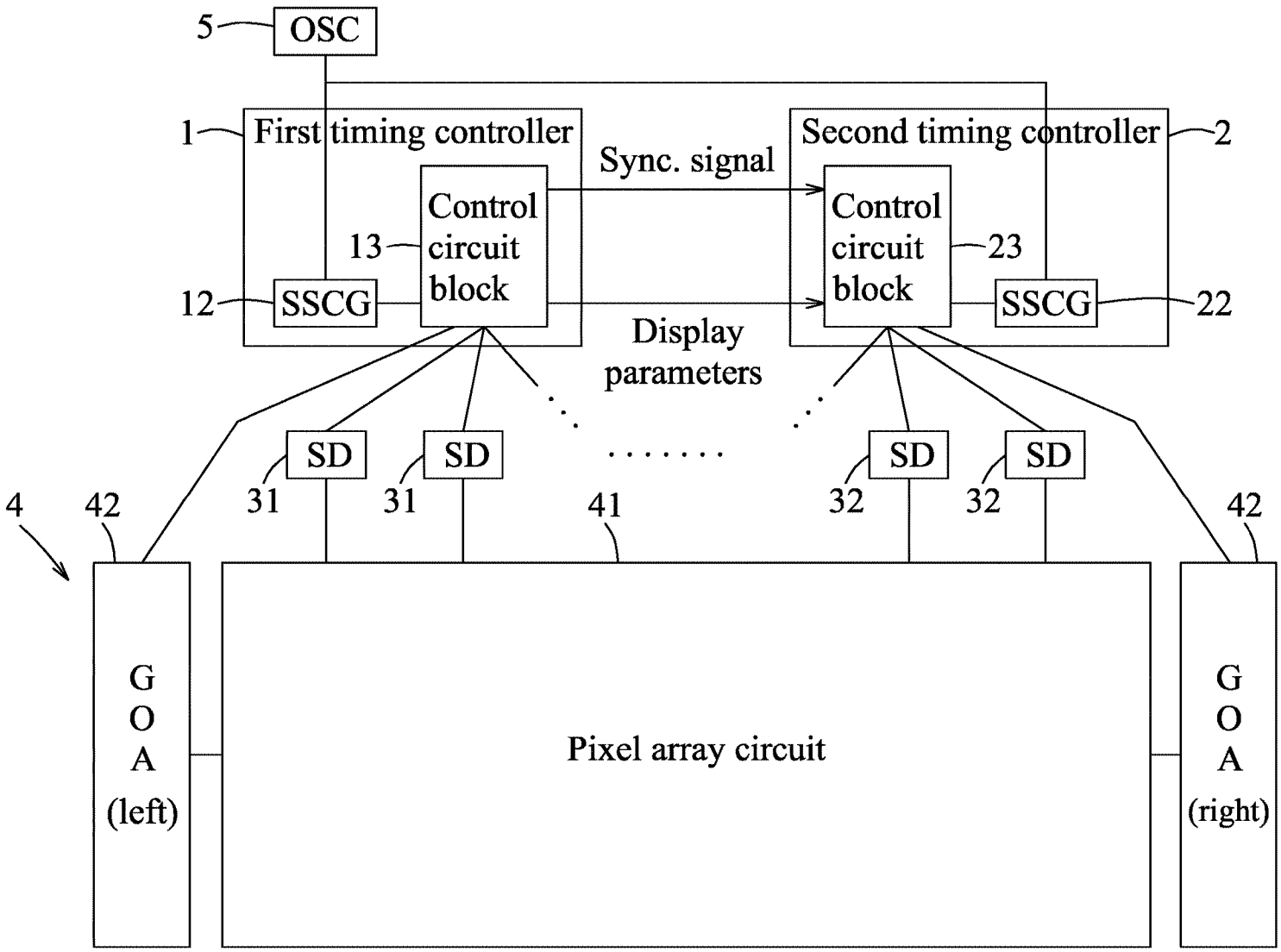
FIG. 4 is a block diagram illustrating a variation of the first embodiment.

FIG. 4 exemplarily illustrates a variation of the first embodiment, where the first and second timing controllers 1, 2 do not include an oscillator therein. Instead, there is an external oscillator 5 providing an oscillating signal to the SSCG 12 to serve as the first clock signal, and to the SSCG 22 to serve as the second clock signal.

Figure 5:
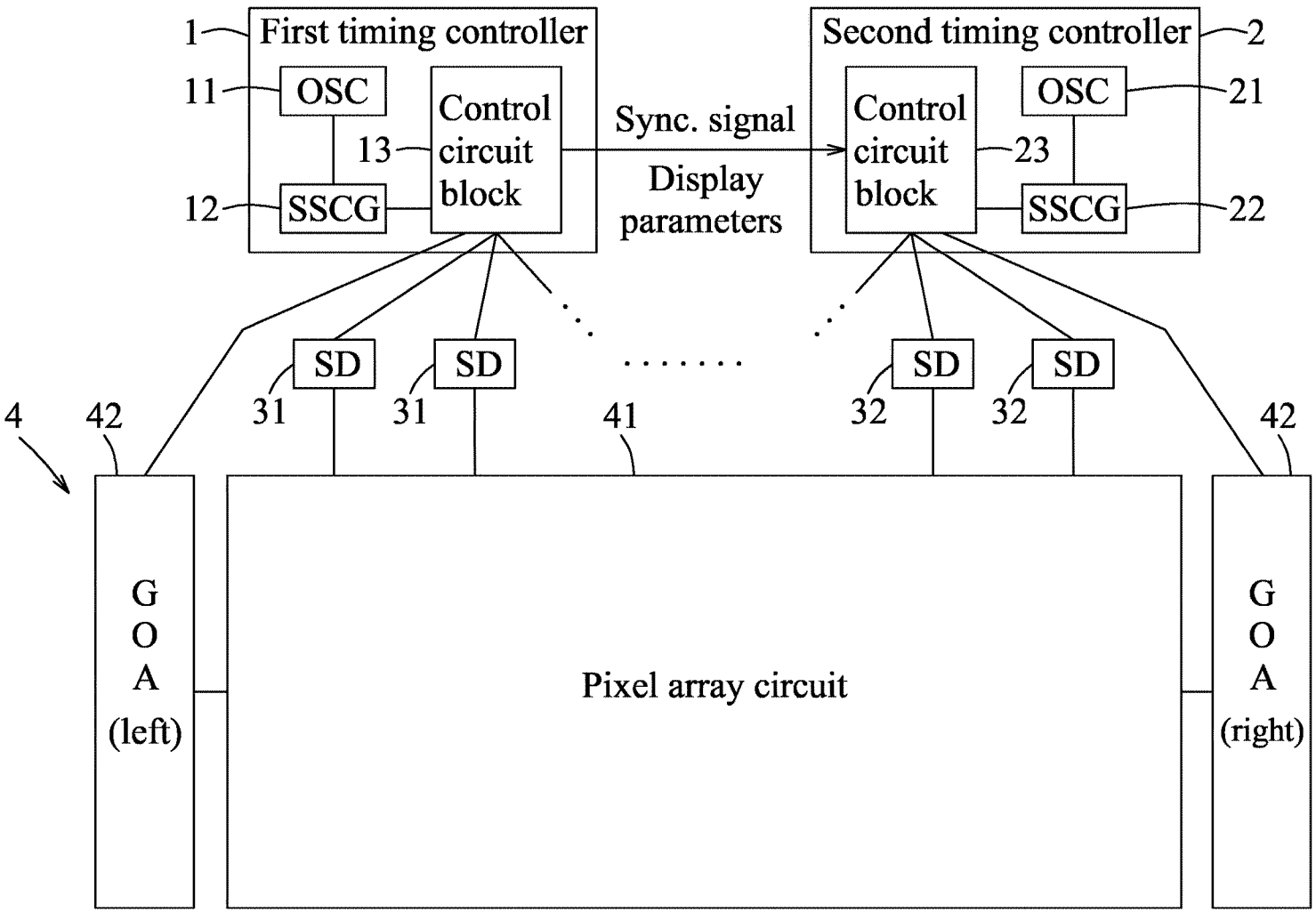
FIG. 5 is a block diagram illustrating a second embodiment of a system that includes multiple timing controllers according to this disclosure.

FIG. 5 exemplarily illustrates a second embodiment of a system that includes multiple timing controllers to manage output of display data for a display panel. The second embodiment differs from the first embodiment in that, in the second embodiment, the control circuit block 13 of the first timing controller 1 outputs the display parameters and the synchronization signal to the control circuit block 23 of the second timing controller 2 via the same path. In this embodiment, the synchronization signal may be outputted in a form of a command composed of a sequence of digital values. For example, the synchronization signal may be defined as a 16-bit command, composed of a sequence of binary values of "1100101001100101".

Figure 6:
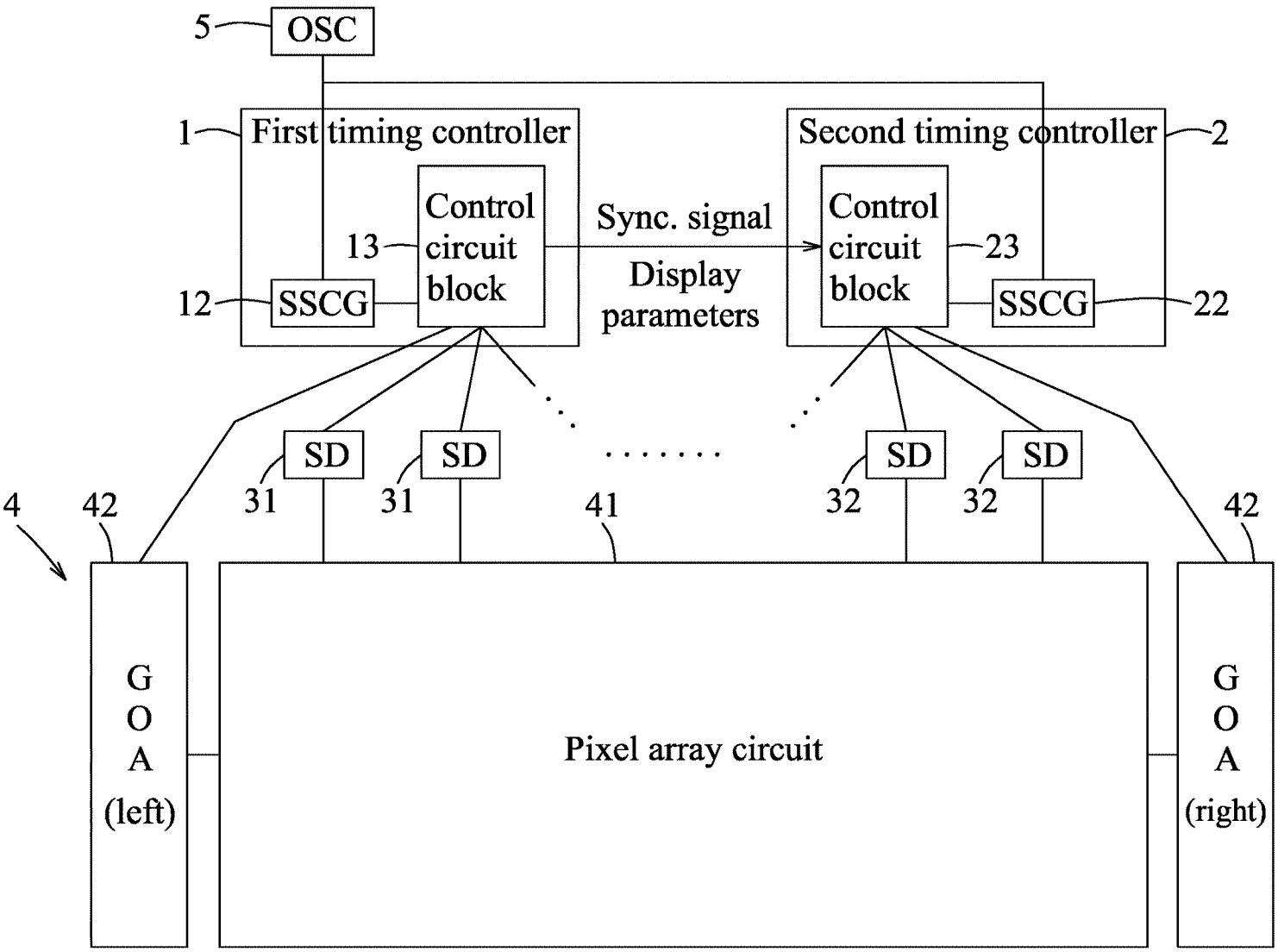
FIG. 6 is a block diagram illustrating a variation of the second embodiment.

FIG. 6 exemplarily illustrates a variation of the second embodiment, where the first and second timing controllers 1, 2 do not include an oscillator therein. Instead, there is an external oscillator 5 providing an oscillating signal to the SSCG 12 to serve as the first clock signal and to the SSCG 22 to serve as the second clock signal.

In summary, the embodiments of this disclosure use the synchronization signal to synchronize the spread spectrum operations of multiple timing controllers of a display panel, making the data output periods the same among the timing controllers, and eliminating the displaying defects in the prior art due to the spread spectrum operations being out of sync among multiple timing controllers.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A timing controller of a display panel, comprising:

a spread spectrum clock generator (SSCG) disposed to receive a clock signal, and configured to perform a spread spectrum operation on the clock signal based on a set of spreading factors, so as to output a modulated clock signal having a varying frequency that varies with a fixed pattern, wherein one complete cycle of the frequency variation of the modulated clock signal occurs in a frequency modulation period defined by the spreading factors; and a control circuit block coupled to said SSCG for receiving the modulated clock signal, and configured to output display data for the display panel within a data output period related to the modulated clock signal, and to output a synchronization signal to another timing controller of the display panel at a predefined time point in the frequency modulation period, such that the another timing controller synchronizes a spread spectrum operation performed thereby with that performed by said SSCG upon receiving the synchronization signal.

2. The timing controller of claim 1, wherein the frequency of the modulated clock signal is, at the predefined time point in the frequency modulation period, equal to a frequency of the clock signal received by said SSCG.

3. The timing controller of claim 1, wherein said control circuit block is further configured to output a set of display parameters to the another timing controller via a first signal path, so as to make the another timing controller output display data for the display panel based on the same display parameters as used by said control circuit block to output display data;

wherein the display parameters define the data output period based on the modulated clock signal; and wherein said control circuit block outputs the synchronization signal to the another timing controller via a second signal path different from the first signal path, and the synchronization signal is a single signal that has a predetermined logic level.

4. The timing controller of claim 1, wherein said control circuit block is further configured to output a set of display parameters to the another timing controller, so as to make the another timing controller output display data for the display panel based on the same display parameters as used by said control circuit block to output display data;

wherein the display parameters define the data output period based on the modulated clock signal; and wherein said control circuit block outputs the synchronization signal to the another timing controller via a signal path, via which the display parameters are outputted to the another timing controller, and the synchronization signal is a command composed of a sequence of digital values.

5. A method for synchronizing spread spectrum operations among multiple timing controllers of a display panel, comprising:

by a timing controller of the display panel, performing a spread spectrum operation on a clock signal based on a set of spreading factors, and generating a modulated clock signal having a varying frequency that varies with a fixed pattern, wherein one complete cycle of the frequency variation of the modulated clock signal occurs in a frequency modulation period defined by the spreading factors; and by the timing controller, outputting display data for the display panel within a data output period related to the modulated clock signal, and outputting a synchronization signal to another timing controller of the display panel at a predefined time point in the frequency modulation period, such that the another timing controller synchronizes a spread spectrum operation performed thereby with that performed by the timing controller upon receiving the synchronization signal.

6. The method of claim 5, wherein the frequency of the modulated clock signal is, at the predefined time point in the frequency modulation period, equal to a frequency of the clock signal.

7. The method of claim 5, further comprising:

by the timing controller, outputting a set of display parameters to the another timing controller via a first signal path, so as to make the another timing controller output display data for the display panel based on the same display parameters as used by the timing controller to output display data;

wherein the display parameters define the data output period based on the modulated clock signal; and wherein the synchronization signal is outputted to the another timing controller via a second signal path different from the first signal path, and the synchronization signal is a single signal that has a predetermined logic level.

8. The method of claim 5, further comprising:

by the timing controller, outputting a set of display parameters to the another timing controller, so as to make the another timing controller output display data for the display panel based on the same display parameters as used by the timing controller to output display data;

wherein the display parameters define the data output period based on the modulated clock signal; and wherein the synchronization signal is outputted to the another timing controller via a signal path via which the display parameters are outputted to the another timing controller, and the synchronization signal is a command composed of a sequence of digital values.

9. A system to manage output of display data for a display panel, comprising:

a first timing controller that includes:

a spread spectrum clock generator (SSCG) disposed to receive a first clock signal, and configured to perform a spread spectrum operation on the first clock signal based on a set of spreading factors, so as to output a modulated first clock signal having a varying frequency that varies with a fixed pattern, wherein one complete cycle of the frequency variation of the modulated first clock signal occurs in a frequency modulation period defined by the spreading factors; and a control circuit block coupled to said SSCG for receiving the modulated first clock signal, and configured to output display data for the display panel within a first data output period related to the modulated first clock signal, and to output a synchronization signal at a predefined time point in the frequency modulation period; and a second timing controller that includes:

an SSCG disposed to receive a second clock signal, and configured to perform a spread spectrum operation on the second clock signal, so as to output a modulated second clock signal having a varying frequency that varies with a fixed pattern; and a control circuit block coupled to said SSCG of said second timing controller for receiving the modulated second clock signal, coupled to said control circuit block of said first timing controller for receiving the synchronization signal, and configured to output display data for the display panel within a second data output period related to the modulated second clock signal;

wherein said control circuit block of said second timing controller is further configured to make said SSCG of said second timing controller synchronize the spread spectrum operation performed thereby with that performed by said SSCG of said first timing controller upon receiving the synchronization signal, so as to make the modulated second clock signal synchronized with the modulated first clock signal.

10. The system of claim 9, wherein the frequency of the modulated first clock signal is, at the predefined time point in the frequency modulation period, equal to a frequency of the first clock signal received by said SSCG of said first timing controller.

11. The system of claim 9, wherein said control circuit block of said first timing controller uses a set of display parameters to define the first data output period based on the modulated first clock signal, outputs display data for the display panel based on the display parameters, and is further configured to output the display parameters to said control circuit block of said second timing controller via a first signal path;

wherein, upon receipt of the display parameter from said control circuit block of said first timing controller via the first signal path, said control circuit block of said second timing controller uses the display parameters to define the second data output period based on the modulated second clock signal; and wherein said control circuit block of said first timing controller outputs the synchronization signal to said control circuit block of said second timing controller via a second signal path different from the first signal path, and the synchronization signal is a single signal that has a predetermined logic level.

12. The system of claim 9, wherein said control circuit block of said first timing controller uses a set of display parameters to define the first data output period based on the modulated first clock signal, outputs display data for the display panel based on the display parameters, and is further configured to output the display parameters to said control circuit block of said second timing controller;

wherein, upon receipt of the display parameter from said control circuit block of said first timing controller, said control circuit block of said second timing controller uses the display parameters to define the second data output period based on the modulated second clock signal; and wherein said control circuit block of said first timing controller outputs the synchronization signal to said control circuit block of said second timing controller via a signal path via which the display parameters are outputted to said control circuit block of said second timing controller, and the synchronization signal is a command composed of a sequence of digital values.

* * * * *